United States Patent [19]

Mueller et al.

[11] Patent Number: 4,900,171

[45] Date of Patent: Feb. 13, 1990

[54] INK RIBBON AND CORRECTION TAPE CASSETTE COMPATIBILITY

[75] Inventors: Hans W. Mueller, Cortland; Samuel D. Cappotto, Syracuse, both of N.Y.

[73] Assignee: Smith Corona Corporation, Cortland, N.Y.

[21] Appl. No.: 126,152

[22] Filed: Nov. 30, 1987

[51] Int. Cl.[4] ..... B41J 32/00

[52] U.S. Cl. ..... 400/208; 400/54; 400/249; 400/696; 400/697.1

[58] Field of Search ..... 400/54, 194, 195, 196, 400/196.1, 207, 208, 208.1, 249, 695, 696, 697, 697.1, 232, 234

[56] References Cited

U.S. PATENT DOCUMENTS

| | | | |
|---|---|---|---|
| 3,731,781 | 5/1973 | Caudill et al. | 400/208 |
| 4,239,107 | 12/1980 | Boyatt, Jr. et al. | 400/208 |
| 4,247,210 | 1/1981 | Kacmarcik et al. | 400/697.1 X |
| 4,302,118 | 11/1981 | Schaefer | 400/208 |
| 4,329,072 | 5/1982 | Kacmarcik | 400/697.1 X |
| 4,347,007 | 8/1982 | Schaefer | 400/208 |
| 4,350,453 | 9/1982 | Field et al. | 400/696 X |
| 4,353,651 | 10/1982 | Schaefer | 400/208 |
| 4,397,575 | 8/1983 | Aldrich | 400/208 |
| 4,407,593 | 10/1983 | Haftmann | 400/208 |
| 4,516,137 | 5/1985 | Yasui | 400/208.1 X |
| 4,611,936 | 9/1986 | Yasui | 400/208 |
| 4,611,938 | 9/1986 | Rettke et al. | 400/208 |
| 4,616,945 | 10/1986 | Komplin | 400/697.1 |
| 4,636,097 | 1/1987 | Goubeaux | 400/208 X |
| 4,747,714 | 5/1988 | Moritz et al. | 400/697.1 X |

FOREIGN PATENT DOCUMENTS

| | | | |
|---|---|---|---|
| 2705127 | 2/1977 | Fed. Rep. of Germany | 400/196.1 |
| 3346482 | 7/1984 | Fed. Rep. of Germany | 400/249 |
| 0144985 | 11/1981 | Japan | 400/54 |
| 0078879 | 5/1984 | Japan | 400/249 |
| 0093376 | 5/1984 | Japan | 400/249 |
| 0031284 | 2/1986 | Japan | 400/249 |
| 0146576 | 7/1986 | Japan | 400/249 |
| 2179917 | 3/1987 | United Kingdom | 400/249 |

OTHER PUBLICATIONS

IBM Technical Disclosure Bulletin, "Two-Color Cartridge Ribbon System With Correction", Schaefer, vol. 22, No. 6, Nov. 1979, pp. 2327–2329.

IBM Technical Disclosure Bulletin, "Protective Carton", Dunning et al., vol. 25, No. 4, Sep. 1982, pp. 1944–1945.

IBM Technical Disclosure Bulletin, "Low Cost Cartridge Code Detector", Craft, vol. 25, No. 4, Sep. 1982, pp. 1980–1981.

IBM Technical Disclosure Bulletin, "Page Width Ribbon Cartridge and Drive Mechanism", Thorne, vol. 25, No. 4, Sep. 1982, pp. 2020–2022.

IBM Technical Disclosure Bulletin, "Web-Tension Sensing Devices", Buchholz et al., vol. 25, No. 4, Sep. 1982, pp. 2066–2067.

IBM Technical Disclosure Bulletin, "Constant Head Wrap Tape Drive", Wenner, vol. 25, No. 4, Sep. 1982, p. 2068.

IBM Technical Disclosure Bulletin, "Web-Guiding Stress Functions", Winarski, vol. 25, No. 4, Sep. 1982, p. 2069.

IBM Technical Disclosure Bulletin, "Stuffer Ribbon Cartridge", Purcell, vol. 25, No. 4, Sep. 1982, pp. 2153–2154.

IBM Technical Disclosure Bulletin, "End-of-Ribbon Sensor and Cartridge-Present Indicator", Jenkins, vol. 27, No. 6, Nov. 1984, pp. 3645"3647.

*Primary Examiner*—Ernest T. Wright, Jr.

[57] ABSTRACT

A means for assuring ink ribbon and correction tape compatibility in a device which utilizes a first cassette having an ink ribbon therein and second cassette having a correction tape therein including a switch means in the device that controls the on-off condition of the device, and means located on one of the cassettes which will activate the on-off switch only when the device contains an ink ribbon in the first cassette which is functionally compatible with the correction tape in the second cassette, such as, for example, functional compatibility between a single-strike ink ribbon and a lift-off correction tape, or functional compatibility between a multiple-strike ink ribbon and a cover-up correction tape.

23 Claims, 4 Drawing Sheets

INK RIBBON AND CORRECTION TAPE CASSETTE COMPATIBILITY

CROSS-REFERENCES TO RELATED APPLICATIONS

There are no related applications.

STATEMENTS AS TO RIGHTS TO INVENTIONS MADE UNDER FEDERALLY SPONSORED RESEARCH AND DEVELOPMENT

The invention disclosed and claimed herein was not made under any federally sponsored research and development program.

BACKGROUND OF THE INVENTION (1) Field of the Invention

This invention is directed to devices such as typewriters or text printers which utilize at least two different cassettes, such as a ribbon cassette and a correcting cassette. Means are provided to assure that the cassettes are functionally compatible with each other. That is achieved, in general, by conditioning the operability of the device on whether or not the cassettes are functionally compatible with each other.

(2) Description of the Prior Art

Various prior art devices disclose means by which the operability of a typewriter or printer is controlled by the condition or type of cassette present in the typewriter or printer. U.S. Pat. No. 4,636,097, for example, includes means for rendering the printer inoperable when the end of the typewriter ribbon in a cassette is sensed, or when there is no cassette in the printer. Another such device is disclosed in IBM Technical Disclosure Bulletin, "Low Cost Cartridge Code Detector," Craft, Volume 25, No. 4, Sept. 1982, pp. 1980, 1981. The cassette disclosed therein provides a signal to the device (such as a typewriter) which identifies the contents of the cassette, so that the device may adjust to the characteristics of the cassette contents. Still another such device is disclosed in U.S. Pat. No. 4,516,137 wherein the presence or absence of a thermal ribbon cassette is sensed by the printer. If a thermal ribbon cassette is present, the printer can print only unidirectionally, whereas when the ribbon cassette is not present, the printer prints bi-directionally.

There are, in addition, prior art devices which disclose means for connecting a ribbon cassette to a correcting cassette. Examples of such prior art devices are U.S. Pat. No. 4,239,107 and U.S. Pat. No. 4,302,118. The '118 patent also discloses means on the cassette which control the selection of the correct feed and ribbon lift mechanism.

SUMMARY OF THE INVENTION

The present invention is directed to means for making certain that in devices, such as typewriters or printers which may utilize at least two different cassettes, such as a ribbon cassette and a correcting cassette, the cassettes are functionally compatible with each other.

In common practice, a typewriter ribbon cassette includes a plastic jacketing in which the ribbon and various components are conveniently housed. These components may include, among other things, a supply spool upon which a supply of typewriter ribbon is located; mechanism for assuring the uniform withdrawal of ribbon from the supply spool to the typewriter print point; and a take-up spool on which the typed ribbon is located. A typewriter drive mechanism rotates the take-up spool to cause fresh ribbon from the supply spool to advance to the print point. A typewriter ribbon cassette of this type is disclosed in U.S. Pat. No. 4,302,118.

Such typewriter ribbon cassettes may contain various types of ribbons. For example, the ribbon may be of the single-strike carbon ribbon type or of the multiple-strike carbon ribbon type. If the ribbon is a single-strike carbon ribbon, the ribbon is incrementally fed in such a manner that upon a single character being typed on a portion of the ribbon, the ribbon is advanced so that the next character is typed on a fresh portion of the ribbon.

If the ribbon is a multiple-strike ribbon, such as the "Multi-Strike" ribbon sold by Smith Corona Corporation, the ribbon is incrementally fed in such a manner that upon a character being typed on a ribbon, the ribbon is advanced a lesser distance so that the next character is typed on a ribbon portion comprising both a typed ribbon portion and a fresh ribbon portion. In this manner, significantly more characters may be typed on a multiple-strike ribbon than on a single-strike ribbon.

A typewriter correcting cassette may also include a plastic jacketing for conveniently housing a correcting tape and various components. As in the typewriter ribbon cassette, the components of a correcting cassette may include a supply spool, means for assuring the uniform withdrawal of correcting tape from the supply spool and a take-up spool. Here, too, the correcting tape may be of two types, namely, the type commonly referred to as "lift-off" tape, in which the tape, upon striking the unwanted character, removes the unwanted character from the paper, or the type commonly referred to as "cover-up" tape, in which, upon the tape striking the unwanted character, a powdered material on the tape is transferred to and covers up the unwanted character on the paper.

In the existing market, with few exceptions, lift-off correcting tape is only compatible with single-strike carbon ribbons, and cover-up correcting tape is only compatible with multiple-strike carbon ribbons. Therefore, in a typewriter which permits the use of both single-strike and multiple-strike ribbons as well as both lift-off and cover-up correcting tapes, it is desirable to provide means to assure that the lift-off correcting tape is used only with compatible single-strike carbon ribbons and that the cover-up tape is used only with compatible multiple-strike ribbons. The present invention is directed to means for providing a simple, reliable means to assure that the lift-off tape cassette can be used only with the compatible single-strike ribbon cassette and that the cover-up tape cassette can be used only with the compatible multiple-strike ribbon cassette.

That is achieved, in general, by providing a switch means in the typewriter or printer that controls the on-off condition of the typewriter, and means located on the ribbon cassette that activates the on-off typewriter switch means. According to the present invention, the ribbon cassette activating means will not activate the on-off typewriter switch when functionally incompatible cassettes are present in the typewriter. In other words, the ribbon cassette activating means will activate the on-off typewriter switch only when either a single-strike ribbon cassette and a compatible cover-up correction tape cassette are present in the typewriter or when a multiple-strike ribbon cassette and a compatible lift-off correction tape cassette are present in the typewriter.

BRIEF DESCRIPTION OF THE DRAWING

A further understanding of the present invention may be had when the following detailed description is read in conjunction with the accompanying drawings, in which:

FIG. 6 is a top perspective view of a conventional typewriter within which the present invention may be used.

DETAILED DESCRIPTION OF THE PREFERRED EMBODIMENT

Figure 1:
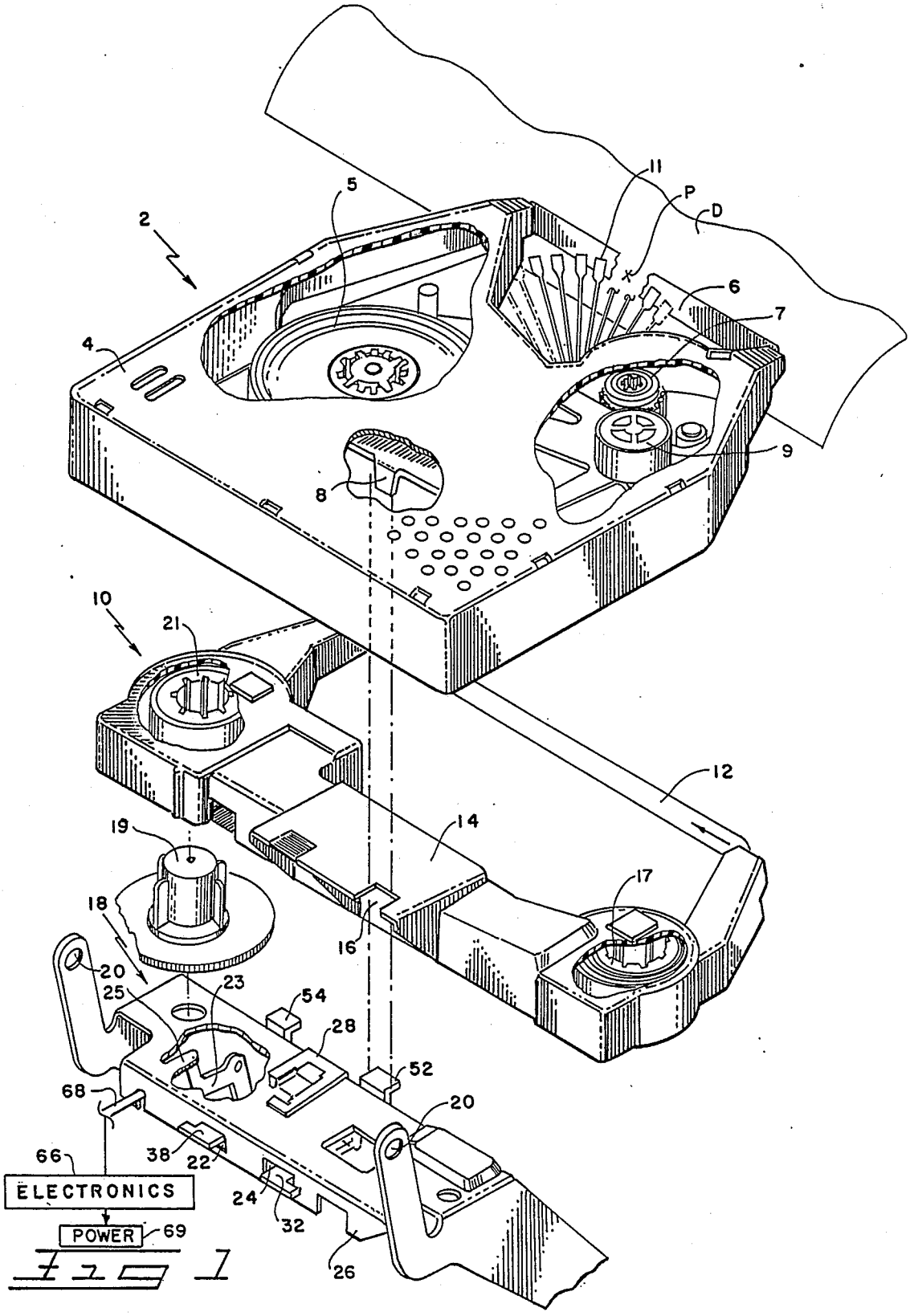
FIG. 1 is an exploded top perspective view of the present invention showing a first typewriter ribbon cassette having a switch activating means thereon, a first correction tape cassette, a partial view of a shiftable bracket section which carries the ribbon cassette and correction tape thereon, and a partial view of the on-off switch mechanism.

There is shown in FIG. 1 a first typewriter ribbon cassette 2 having a housing 4 within which a first typewriter ribbon 6 (which may be of the single-strike carbon ribbon type), and various other components, are housed. A tab 8 extends from the right-hand portion of the bottom of the housing 4 for a purpose to be described hereinafter. As noted above, a single-strike carbon ribbon is of the type which is incrementally fed in such a manner that upon a character being typed on a ribbon portion, the ribbon is advanced so that the next character is typed on a fresh portion of the ribbon. These components, may include, among other things, a supply roll 5 upon which a typewriter ribbon supply is located, a mechanism 7 for assuring the uniform withdrawal of ribbon 6 from the supply roll 5 to the typewriter print point P (best seen in FIG. 6), and a take-up spool 9 on which the typed ribbon is located. Such a cassette is presently being sold by Smith Corona Corporation under its "H Correctable" mark.

Also in FIG. 1, there is disclosed a first correction tape cassette 10 which is functionally compatible with the first typewriter ribbon cassette 2, and within which a first correction tape 12 of, for example, the lift-off type, together with other components, is housed. Such a cassette is described in copending U.S. patent application Ser. No. 161,870 filed Feb. 29, 1988 by Hans W. Mueller, entitled "Tape Cassette for Metering Correction Tape Feed". In operation, to delete an unwanted typed character from document D, the lift-off tape 12 is raised to the print point P (best seen in FIG. 6) over the character, and the unwanted character on the type element 11 of a typewriter 13 (best seen in FIG. 6) is positioned to strike the lift-off tape 12. Typewriter actuating means, such as a typewriter key 15 (best seen in FIG. 6) causes the type element 11 to strike the lift-off tape 12 against the unwanted character on the document D, and the lift-off tape 12 withdraws the unwanted character from the document D.

The components in the first correction tape cassette 10 may include a supply roll 17 of correcting tape 12, means 19 for assuring the uniform withdrawal of correcting tape 12 from the supply roll 17 and a take-up spool 21. The first correction tape cassette 10 also includes a flat portion 14 having an opening 16 in the right-hand portion, through which the tab 8 of the first typewriter ribbon cassette 2 extends when the cassettes 2, 10 are inserted into the typewriter 13. As used herein, a functionally compatible cassette is one in which the ink ribbon in the first cassette is functionally compatible with the correction tape in the second cassette.

FIG. 1 further discloses a shiftable bracket section 18 carrying the first typewriter ribbon cassette 2 and the first correction tape cassette 10. The shiftable bracket section 18 is pivotable about pivot points 20 by conventional typewriter means 23 and 25 for presenting either the first typewriter ribbon 6 or the lift-off first correction tape 12 to the typewriter print point P (best seen in FIG. 6).

Figure 3:
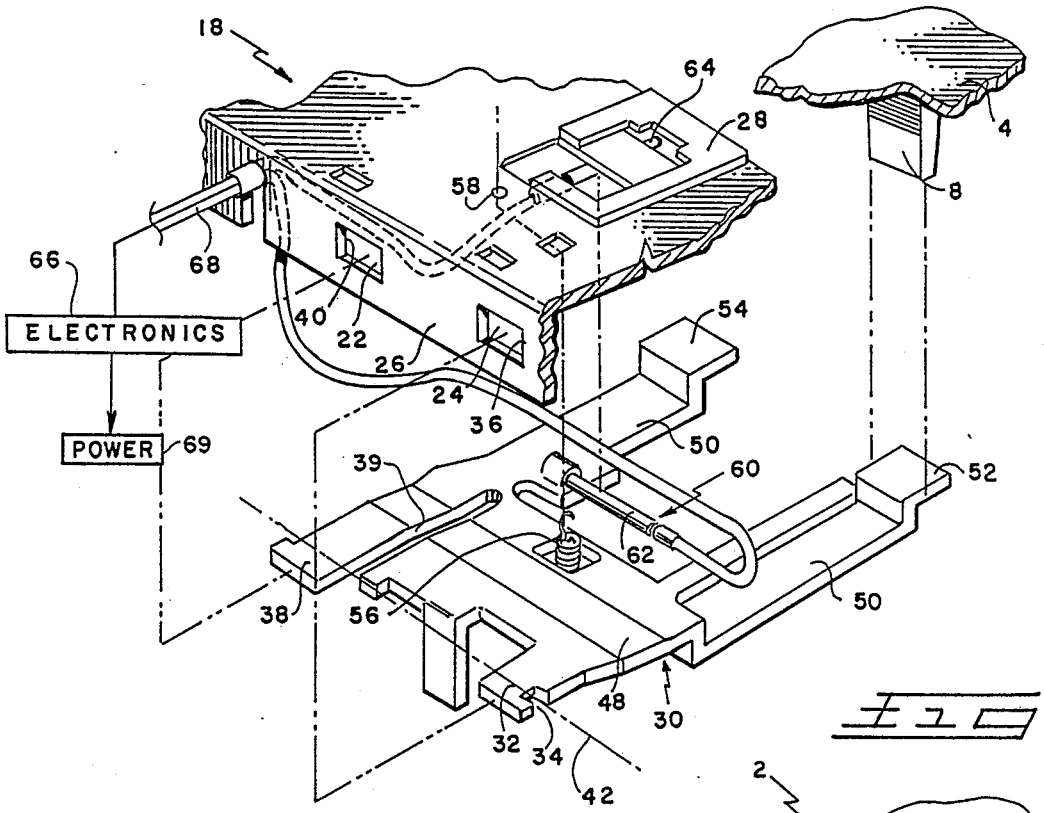
FIG. 3 is an exploded top perspective view of the present invention showing a partial view of the switch activating means located on the first typewriter ribbon cassette, a partial view of the shiftable bracket section which carries the ribbon cassette and correction tape thereon, and the on-off switch.

As shown in FIGS. 1 and 3, the shiftable bracket section 18 has an opening 22 and an opening 24 in a front portion 26. A clip 28 is clamped to the shiftable bracket section 18. An on-off switch rocker 30 (the operation of which will be described hereinafter) is assembled to the shiftable bracket section 18 by means of a first finger 32 of the on-off switch rocker 30 extending through the opening 24 of shiftable bracket section 18. A notch 34 in switch rocker 30 receives a wall portion 36 of the opening 24. The first finger 32 seated against the wall portion 36 provides a first pivot point for the on-off switch rocker 30.

A second finger 38 of the on-off switch rocker 30 extends through the opening 22 in shiftable bracket section 18 and abuts against a wall portion 40 of the opening 22 to provide a second pivot point for the on-off switch rocker 30. The second finger 38 is integrally molded with the on-off switch rocker 30, being partially separated therefrom by a slot 39 in such a manner that the second finger 38 is laterally biased against the wall portion 40 and causes the first finger 32 to be biased against the wall portion 36 for holding the on-off switch rocker 30 assembled to the shiftable bracket section 18. The first pivot point of the first finger 32 is substantially in alignment with the second pivot point of the second finger 38 to provide a common axis 42 for pivoting the on-off switch rocker 30 relative to the shiftable bracket section 18.

Figure 2:
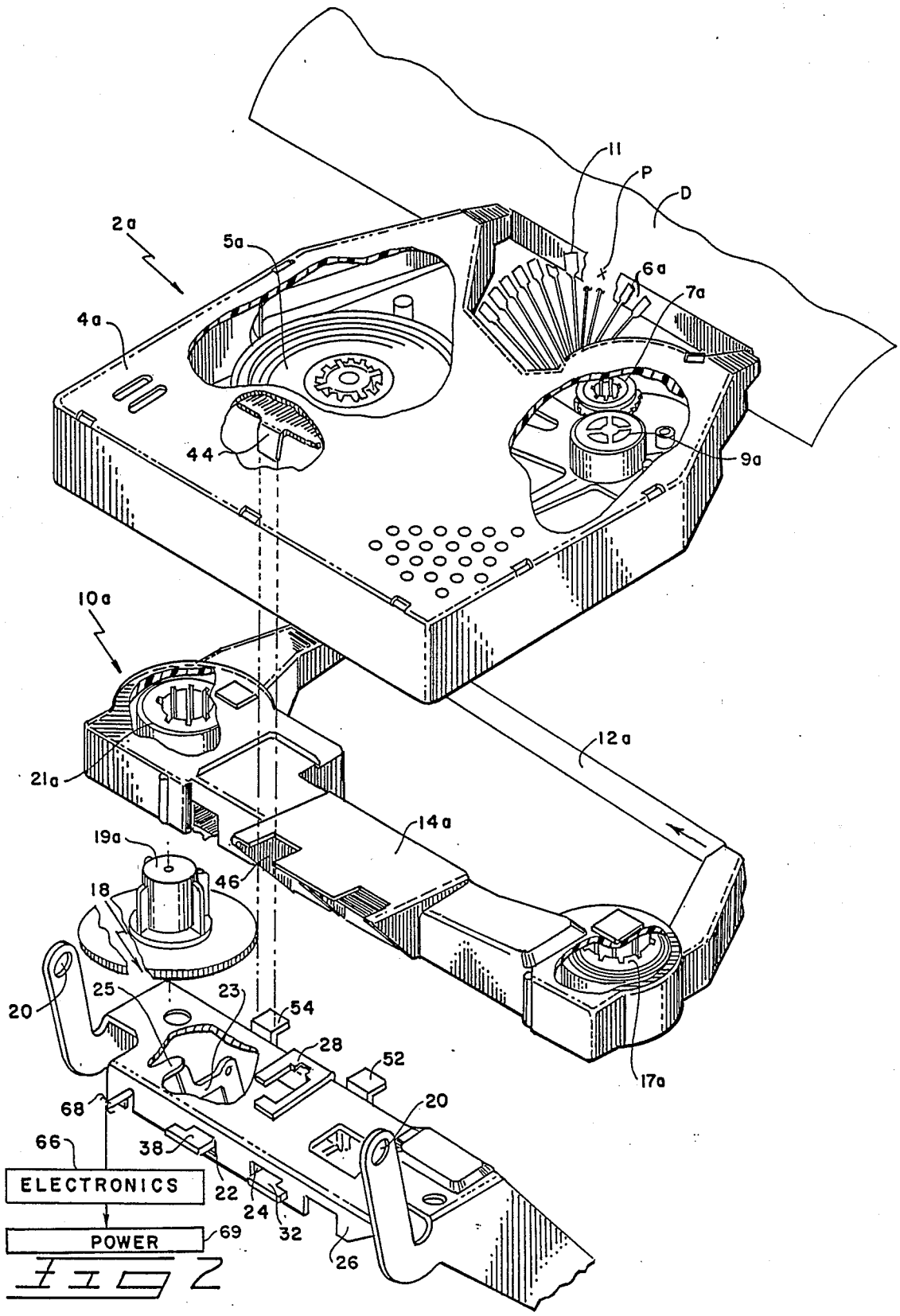
FIG. 2 is an exploded top perspective view of the present invention showing a second typewriter ribbon cassette having a switch activating means thereon, a second correction tape cassette, a partial view of a shiftable bracket section which carries the ribbon cassette and correction tape thereon, and a partial view of the on-off switch.

FIG. 2 shows a second typewriter ribbon cassette 2*a* and a second correction tape cassette 10*a* which are generally similar in construction to the first typewriter ribbon cassette 2 and the first correction tape cassette 10 shown in FIG. 1. Therefore, in large part, the same numerical reference numerals will be used in FIG. 2 as were used in FIG. 1, except that the letter "*a*" will be added to the reference numerals of FIG. 2.

There is shown in FIG. 2 the second typewriter ribbon cassette 2*a* having a housing 4*a* within which a second typewriter ribbon 6a, which may be of the multiple-strike carbon ribbon type, and various other components are housed. A tab 44 extends from the left-hand portion of the bottom of the housing 4a for the purpose to be hereinafter described. As noted above, a multiple-strike carbon ribbon is of the type which is incrementally fed in such a manner that upon a character being typed on a ribbon portion, the ribbon is advanced so that the next character is typed on a ribbon portion comprising both a typed ribbon portion and a fresh ribbon portion. These components may include, among other things, a supply roll 5a upon which a typewriter ribbon supply is located, mechanism 7a for assuring the uniform withdrawal of ribbon 6a from the supply roll 5a to the typewriter print point P (best seen in FIG. 6); and a take-up spool 9a on which the typed ribbon is located. Such a cassette is presently being sold by Smith Corona Corporation under its "H Multi-Strike" mark.

There is further shown in FIG. 2 the second correction tape cassette 10a which is functionally compatible with the second typewriter ribbon cassette 2a, and within which a second correction tape 12a of, for example, the cover-up type, together with other components, is housed. In operation, to delete an unwanted typed character from a document, the cover-up tape 12a is raised to the print point P over the character, and the unwanted character on the type element 11 is positioned to strike the cover-up tape 12a. Typewriter actuating means 15 causes the type element 11 to strike the cover-up tape 12a against the unwanted character on document D, and the cover-up tape 12a is transferred to and covers up the unwanted character.

The components in the second correction tape cassette 10a may include a supply roll 17a of correcting tape 12a, means 19a for assuring the uniform withdrawal of correcting tape 12a from the supply roll 17a and a take-up spool 21a. The second correction tape cassette 10a also includes a flat portion 14a having an opening 46 in the left-hand portion, through which the tab 44 of the second typewriter ribbon cassette 2a extends when the cassettes 2a, 10a are inserted into the typewriter 13.

The shiftable bracket section 18 shown in FIG. 2 is the same bracket section shown in FIG. 1. The on-off switch rocker 30 shown in FIG. 3 includes a generally planar portion 48 having two rearwardly extending arms 50 on which an upwardly extending right-hand finger 52 and an upwardly extending left-hand finger 54 are located. A spring means 56 is connected at one end to the on-off switch rocker 30 and at its opposite end to the shiftable bracket section 18 at spring aperture 58. The spring 56 biases the on-off switch rocker 30 counterclockwise about the common axis 42.

A switch 60 has a first switch contact 62 and a second switch contact 64. The first switch contact 62 is securely mounted on the on-off switch rocker 30. The first switch contact 62 has an elongated contact surface with the elongation arranged substantially parallel relative to the common axis 42. The second switch contact 64 is securely mounted on the clip 28 which is assembled to the shiftable bracket section 18. The second switch contact 64 has an elongated contact surface with the elongation arranged substantially perpendicular relative to the first switch contact 62. Although the contacts 62, 64 may be of different shapes, it has been found desirable to make the shapes elongated to reduce the manufacturing tolerances required to have the first switch contact 62 efficiently contact the second switch contact 64 during initial assembly and during continual typewriter operation thereafter. The first and second switch contacts 62 and 64 are connected to electronics 66 mounted in the typewriter 13 by lead lines 68. The electronics 66 is connected to a power source 69 for controlling the flow of electricity to the typewriter 13.

Figure 4:
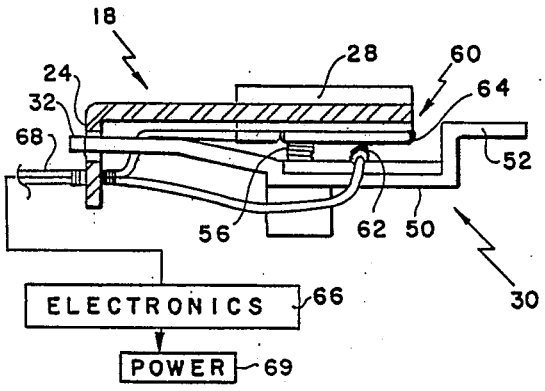
FIG. 4 is a side elevational view of the present invention showing an on-off switch in its normally closed position whereby power cannot be supplied to the device.

Referring to FIG. 4, the spring 56 biases the on-off switch rocker 30 counterclockwise relative to the shiftable bracket section 18 to bias the first switch contact 62 in contact with the second switch contact 64 for closing the switch 60. The switch 60 is closed when neither the first typewriter ribbon cassette 2 nor the second typewriter ribbon cassette 2a is inserted in the typewriter 13. The electronics 66 senses that the switch 60 is closed and thereby prevents the flow of electricity to the typewriter 13.

Figure 5:
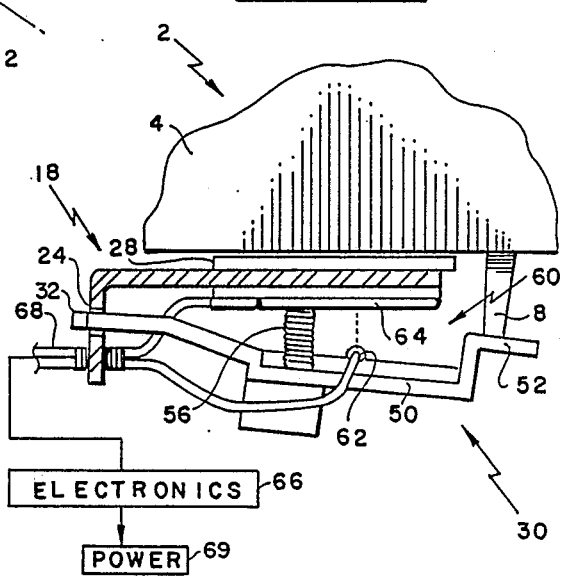
FIG. 5 is a side elevational view of the present invention showing an on-off switch in its normally opened position whereby power can be supplied to the device.
Figure 9:
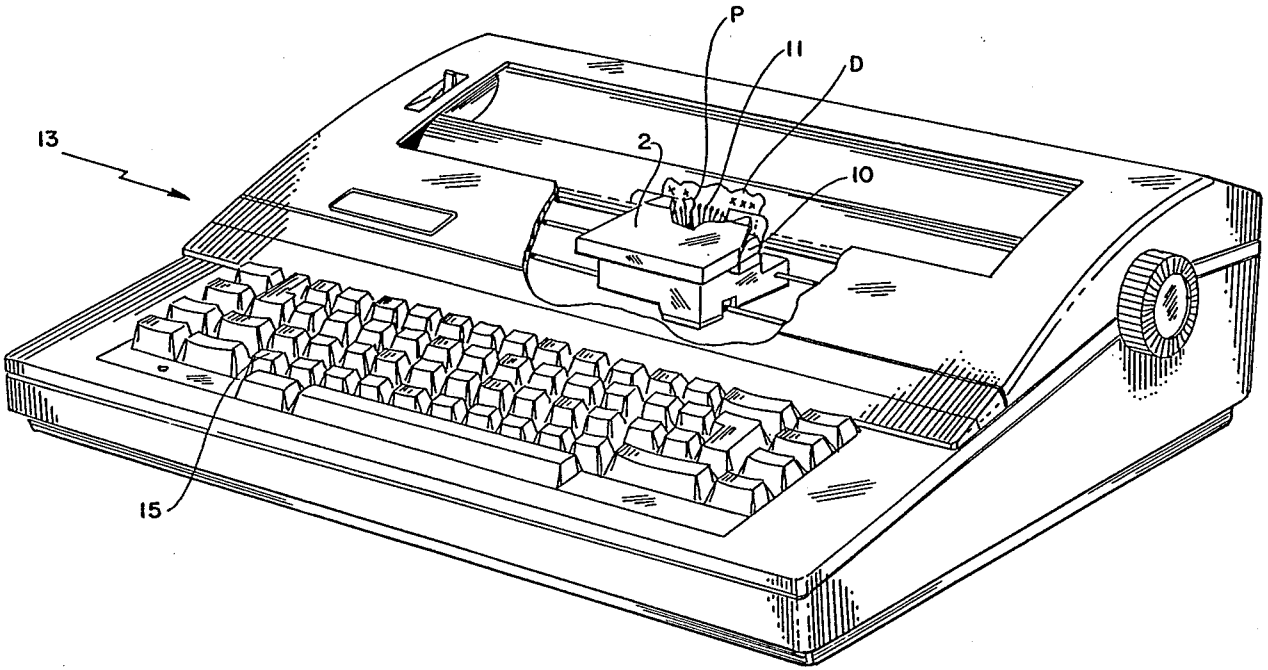

Referring to FIG. 5, when the first typewriter ribbon cassette 2 is inserted into the typewriter 13, the tab 8 conditions the switch 60 as it contacts the right-hand finger 52 and pivots the on-off switch rocker 30 clockwise relative to the shiftable bracket section 18 to open the switch 60. Likewise, when the second typewriter ribbon cassette 2a is inserted into the typewriter 13, the tab 44 contacts the left-hand finger 54 and pivots the on-off switch rocker 30 clockwise to open the switch 60 (FIG. 2). When the electronics 66 senses that the switch 60 is open, it permits the flow of electricity to the typewriter 13.

Downward movement of the tab 8, and thus the flow of electricity to the typewriter 13, will occur when the right-hand tab 8 can extend through the right-hand opening 16 in the flat portion 14 in compatible first correction tape cassette 10. In other words, the flow of electricity will occur when right-hand opening 16 permits right-hand tab 8 to open the switch 60. If, however, instead of the first correction tape cassette 10 being present in the typewriter 13, incompatible second correction tape cassette 10a is present, which has only a left-hand opening 46 in the flat portion 14a, the tab 8 cannot extend downwardly to pivot the on-off switch rocker 30 clockwise, and the flow of electricity to the typewriter 13 cannot occur.

Similarly, with respect to the second typewriter ribbon cassette 2a, the flow of electricity to the typewriter 13 will occur when the left-hand tab 44 can extend through the left-hand opening 46 in the flat portion 14a in compatible second correction tape cassette 10a. That is to say, the flow of electricity will occur when left-hand opening 46 permits left-hand tab 44 to open the switch 60. If, however, instead of second correction tape cassette 10a being present in the typewriter 13, incompatible first correction tape cassette 10 is present, which has only the right-hand opening 16 in the flat portion 14, the tab 44 cannot extend downwardly to pivot the on-off switch rocker 30 clockwise and the flow of electricity to the typewriter 13 cannot occur. Thus, it will be seen that with respect to the embodiment shown in FIGS. 1 to 4, the flow of electricity will not occur when either the first typewriter ribbon cassette 2 and the second correction tape cassette 10a, or the second typewriter ribbon cassette 2a and the first correction tape cassette 10 are present in the typewriter 13. Conversely, the combination of the right-hand tab 8 and the right-hand opening 16 or the combination of the left-hand tab 44 and the left-hand opening 46 will assure that the first and second cassettes which are inserted in the device are functionally compatible with each other.

It is to be understood that the present disclosure of a means for assuring cassette compatibility has been made only by way of example, and that changes in details of construction and the combination and arrangement of parts may be resorted to without departing from the true spirit and scope of the invention as hereinafter claimed.

What is claimed is:

1. In a system utilizing a first and second cassette, said system comprising in combination:

a device in which a first and second cassette are inserted for operation of the device;

a switch mounted on said device and connected to a power source for controlling the flow of electricity to said device;

a first cassette for use in said device, said first cassette having an ink ribbon;

a second cassette for use in said device, said second cassette having a correction tape; and means for assuring that the ink ribbon in the first cassette and the correction tape in the second cassette are functionally compatible with each other and for conditioning the switch to permit the flow of electricity from the power source to said device to activate said device only when the functional compatibility of said ink ribbon in the first cassette and the correction tape in the second cassette is assured.

2. In a system utilizing a first and second cassette in accordance with claim 1 wherein the means for assuring that the ink ribbon of the first cassette and the correction tape of the second cassette are functionally compatible with each other when said cassettes are inserted in said device includes:

said assuring means being located on said first cassette; and means on the second cassette for accommodating said assuring means on the first cassette to condition the switch to allow the flow of electricity to said device.

3. In a system utilizing a first and second cassette in accordance with claim 2 wherein the assuring means on the first cassette for conditioning the switch to allow the flow of electricity to the device is a tab portion.

4. In a system utilizing a first and second cassette in accordance with claim 3, wherein the tab portion is located on the bottom surface of the first cassette.

5. In a system utilizing a first and second cassette in accordance with claim 4, wherein the second cassette has an opening therein through which the tab portion extends.

6. In a system utilizing a first and second cassette in accordance with claim 1, wherein the first and second cassettes are carried by a bracket section on said device, said bracket section including said switch.

7. In a system utilizing a first and second cassette in accordance with claim 5, wherein the tab portion is on the right-hand side of the first cassette and wherein the opening in the second cassette is on the right-hand side of the second cassette.

8. In a system utilizing a first and second cassette in accordance with claim 5, wherein the tab portion is on the left-hand side of the first cassette and wherein the opening in the second cassette is on the left-hand side of the second cassette.

9. In a system utilizing a first and second cassette in accordance with claim 2, wherein the device is a typewriter, the first cassette includes a compatible single-strike ribbon and the second cassette includes a lift-off correction tape.

10. In a system utilizing a first and second cassette in accordance with claim 2, wherein the device is a typewriter, the first cassette includes a multiple-strike ribbon and the second cassette includes a compatible cover-up correction tape.

11. A ribbon cassette for a system including a device utilizing a ribbon cassette and a correction tape cassette having a correction tape which are inserted into the device for the operation thereof, the device operating on a flow of electricity and including a switch for controlling the flow of electricity thereto, said ribbon cassette comprising:

a housing having a bottom;

an ink ribbon substantially disposed within said housing; and means on said ribbon cassette engaging an opening in the correction tape cassette to assure that said ribbon and the correction tape are functionally compatible, said assuring means conditioning the switch to control the flow of electricity to the device.

12. A ribbon cassette in accordance with claim 11, wherein said device is an electric typewriter.

13. A ribbon cassette in accordance with claim 11, wherein said assuring means is a tab extending from said housing.

14. A ribbon cassette in accordance with claim 13 wherein said tab extends from a side portion of said bottom of said housing.

15. A ribbon cassette for a system including a device utilizing a ribbon cassette and a correction tape cassette having a correction tape, said ribbon cassette being inserted into the device for the operation thereof, said ribbon cassette comprising:

a housing having a top surface and a bottom surface;

an ink ribbon substantially disposed within said housing; and a tab portion extending from a specified side portion of the bottom surface of said ribbon cassette, said tab portion matingly engaging and extending through an opening located in a corresponding side portion of the correction tape cassette for assuring that said ink ribbon and the correction tape are functionally compatible and, in the event that said tab does not engage the opening, for indicating that said ribbon and the correction tape are not functionally compatible with each other.

16. A correction tape cassette for use in a system including a device operating on a flow of electricity and including a switch for controlling the flow of electricity thereto, a ribbon cassette having an ink ribbon and a correction tape cassette having a correction tape which are inserted in the device for operation thereof, the ribbon cassette including a housing and having a tab extending from the housing for assuring that the ink ribbon and the correction tape are functionally compatible, and for conditioning the switch to control the flow of electricity to the device, said tape cassette comprising means for enabling the conditioning of the switch by the tab.

17. The correction tape cassette in accordance with claim 16 further including a housing, said enabling means being located on said housing.

18. The correction tape cassette in accordance with claim 17 wherein said enabling means is an opening.

19. The correction tape cassette in accordance with claim 18 wherein includes a tab formation for assuring the functional compatibility of the ink ribbon cassette with the tape said opening accommodates the insertion of the tab formation therethrough to condition the switch.

20. A correction tape cassette for an electric typewriter using an ink ribbon in a cassette and a correction tape cassette, said correction tape cassette comprising:

a housing;

a correction tape substantially disposed within said housing; and an opening positioned in a specified side portion of said housing to accommodate a tab formation extending from a corresponding side portion of the ribbon cassette for assuring functional compatibility between said correction tape and the ink ribbon and, in the event that the tab is not aligned with, and accommodated by said opening, for indicating the functional incompatibility of the ink ribbon and said correction tape.

21. In a system including a device, an ink ribbon cassette having an ink ribbon and a correction tape cassette having a correction tape, a method for inserting the ink ribbon and correction tape cassettes into the device to assure compatibility of the ink ribbon in the ink ribbon cassette with the correction tape in the correction tape cassette and to effect the operation of the device, comprising:

providing the ribbon cassette with means for assuring cassette compatibility;

providing the correction tape cassette with accessibility means through which the assuring means extends;

providing the device with a switch conditionable to activate the device;

inserting the correction tape cassette in the device; and inserting the ink ribbon cassette in the device so that said assuring means engages said accessibility means and conditions said switch to activate the device.

22. The method in accordance with claim 21 further comprising providing said assuring means as a tab.

23. The method in accordance with claim 21 further comprising providing said accessability means as an opening dimensioned to accommodate said assuring means therethrough.

* * * * *